US005185315A

United States Patent [19]

Sparer

[11] Patent Number: 5,185,315

[45] Date of Patent: Feb. 9, 1993

[54] MAKING ENCODED DYE-DONOR FILMS FOR THERMAL PRINTERS

[75] Inventor: Steven J. Sparer, Rochester, N.Y.

[73] Assignee: Eastman Kodak Company, Rochester, N.Y.

[21] Appl. No.: 658,736

[22] Filed: Feb. 21, 1991

[51] Int. Cl.[5] ..... B41M 5/035; B41M 5/26

[52] U.S. Cl. ..... 503/227; 427/152; 427/265; 428/192; 428/195; 428/913; 428/914

[58] Field of Search ..... 8/471; 428/195, 913, 428/914, 192; 503/227; 427/146-148, 256, 286, 152, 258, 261, 265

[56] References Cited

U.S. PATENT DOCUMENTS 4,710,783 12/1987 Caine et al. ..... 346/76 PH
4,745,413 5/1988 Brownstein et al. ..... 346/76 PH
4,849,775 7/1989 Izumi ..... 346/151

FOREIGN PATENT DOCUMENTS 0279467 8/1988 European Pat. Off. ..... 503/227

*Primary Examiner*—B. Hamilton Hess
*Attorney, Agent, or Firm*—Raymond L. Owens

[57] ABSTRACT

A method of making a dye-donor film is provided with printing code marking formed on clear areas interspersed between successive sets of dye patches formed on the film.

4 Claims, 4 Drawing Sheets

MAKING ENCODED DYE-DONOR FILMS FOR THERMAL PRINTERS

FIELD OF THE INVENTION

This invention relates to making dye-donor films for use in thermal printers.

BACKGROUND OF THE INVENTION

Thermal printers are often used in conventional office and laboratory settings. In these settings, the operators of the thermal printers are usually not printing machine specialists but are instead people who have other job functions. In order for a thermal printer to be successfully used in these settings there must be a simple and easily understood method for loading printing material into the printers.

The materials to be loaded in thermal printers are receivers (e.g., either paper sheets or transparency sheets) and dye-donor film. A typical dye-donor color film consists of repeating patches of colored dye formed on a flexible film.

In operation, a thermal printer uses a programmable print head to progressively form an image on a moving receiver in a series of successive lines of print. The dye-donor film is sandwiched between the print head and the moving receiver. The print head heats selected portions of successive lines of an advancing dye patch as the dye-donor film moves along between the print head and the receiver. A computer generated image is thus progressively transferred to the receiver as the receiver and dye patch are moved together under the print head.

The dye-donor film used in a typical thermal printer can be packaged in cartridges that can be easily loaded into the printers. The cartridges are arranged so that an unused portion of the film is successively unrolled from a spool in the cartridge and a used portion of the film is re-rolled onto another spool. Each cartridge typically contains enough dye-donor film to create one-hundred images.

In many applications, a printer is used to make a plurality of images without interruption. In this context, an operator must be assured that the printer is loaded with a cartridge that has a sufficient amount of remaining unused dye-donor film to permit the completion of the entire succession of images. However, the dye-donor film is very thin and it is therefore extremely difficult to estimate the amount of remaining film in the unused section of a cartridge.

In some prior art thermal printers, a reset counter has been used to count the number of patches used in a cartridge. This system is workable only if a cartridge is put into a printer and allowed to remain until completely used. In practice, however, thermal printers are not used in a manner that simply consumes dye-donor film cartridges end to end. A more typical use pattern for a thermal printer involves frequent removal and replacement of partially used cartridges of dye-donor film. For example, the thermal printer may be used to make a number of prints from a black ribbon cartridge. The black ribbon cartridge might then be replaced with a full-color cartridge for a few prints and at a later time or on a later day the black ribbon cartridge might again be placed into the thermal printer. At other times, when confidentiality is a factor, a cartridge might be removed after making only one confidential print. The cartridges retain an imprint of a transferred image and therefore the cartridges must be kept secure when confidential images are being produced.

When cartridges are interchanged on thermal printers, a resetting counter on a printer is virtually useless in determining the number of dye patches remaining in a cartridge. Thus there is a need for a system which indicates how many dye patches remain on a previously used cartridge.

An ostensibly simple method of filling this need is to put identifying numbers on each set of dye patches so that a user of the thermal printer can read the number of remaining patches. However, this solution to the problem has not been applied to dye-donor films in thermal printers because of the unique physical properties of the dye-donor films. In order for a thermal-printing operation to be capable of producing high resolution images, the dye-donor film must have two critical characteristics. First, a supporting web of the film must be extremely thin so that heat transfer can rapidly take place through the film. Secondly, the dye coating on the film must be extremely uniform so that a predictable amount of the dye is transferred in response to a particular amount of energy applied to the print head.

With these critical characteristics to be met, the prior-art techniques for making dye-donor film consisted of coating a clear web with dye in a gravuring process, slitting the coated web into narrower strips of dye-donor film and packaging the film into cartridges. In this prior-art coating technique, it has not been possible to perform sequential numbering of dye patches on the dye-donor film.

The major reason for this previous difficulty resides in the method by which the dye-donor film is coated with dye patches to achieve these important characteristics. A web of polyethylene terephthalate film which typically is only 0.00025 inches thick is used as a base for the dye-donor film. The web is coated with dye in a precisely controlled gravure-deposition process. Within the gravure process the web is advanced with a carefully controlled speed so that a uniform thickness of dye is deposited on the film by engraved dye deposition rollers. The engraved portions of the deposition rollers are carefully sized so that coordinated rotation of a series of these rollers makes a perfectly spaced pattern of uniformly thick dye patches on the thin base film. Any efforts to put ink or dye coding on the web during gravuring have been unsuccessful because of the risk of contaminating the gravuring operation. Efforts to create coding by punching holes in the web have also been unsuccessful because the web is extremely thin and coding holes create a high risk of web breakage or tearing.

An additional problem in producing dye-donor film relates to uniformity of the dye patches from one lot of dye-donor film to the next. In spite of extraordinary effort to control dye thickness and dye uniformity, some variations in the optical color-balance of the dye-donor film still occurs. The thermal printers which use these dye-donor films are calibrated to perform well when a dye-donor film of nominal color-balance is put into the printer. Thus the printers perform at less than their peak capability when using dye-donor film having a color-balance that deviates from a nominal value.

SUMMARY OF THE INVENTION

It is therefore an object of this invention to provide a dye-donor film with numbered sets of dye patches and also to have an encoded color-balance information on the dye-donor film which can be read by a printer.

This object is achieved in a method of making a dye-donor films for thermal printing comprising the steps of:

coating a clear web with successive sets of colored patches of dyes in a gravuring process leaving clear spaces between the successive sets of patches; and printing a color balancing and film length code marking in the clear spaces between each set of dye patches after the dye patches are coated onto the web.

The invention will be better understood from the following detailed description taken in consideration with the accompanying drawings and claims.

The figures are not necessarily drawn to scale.

DETAILED DESCRIPTION

Figure 1:
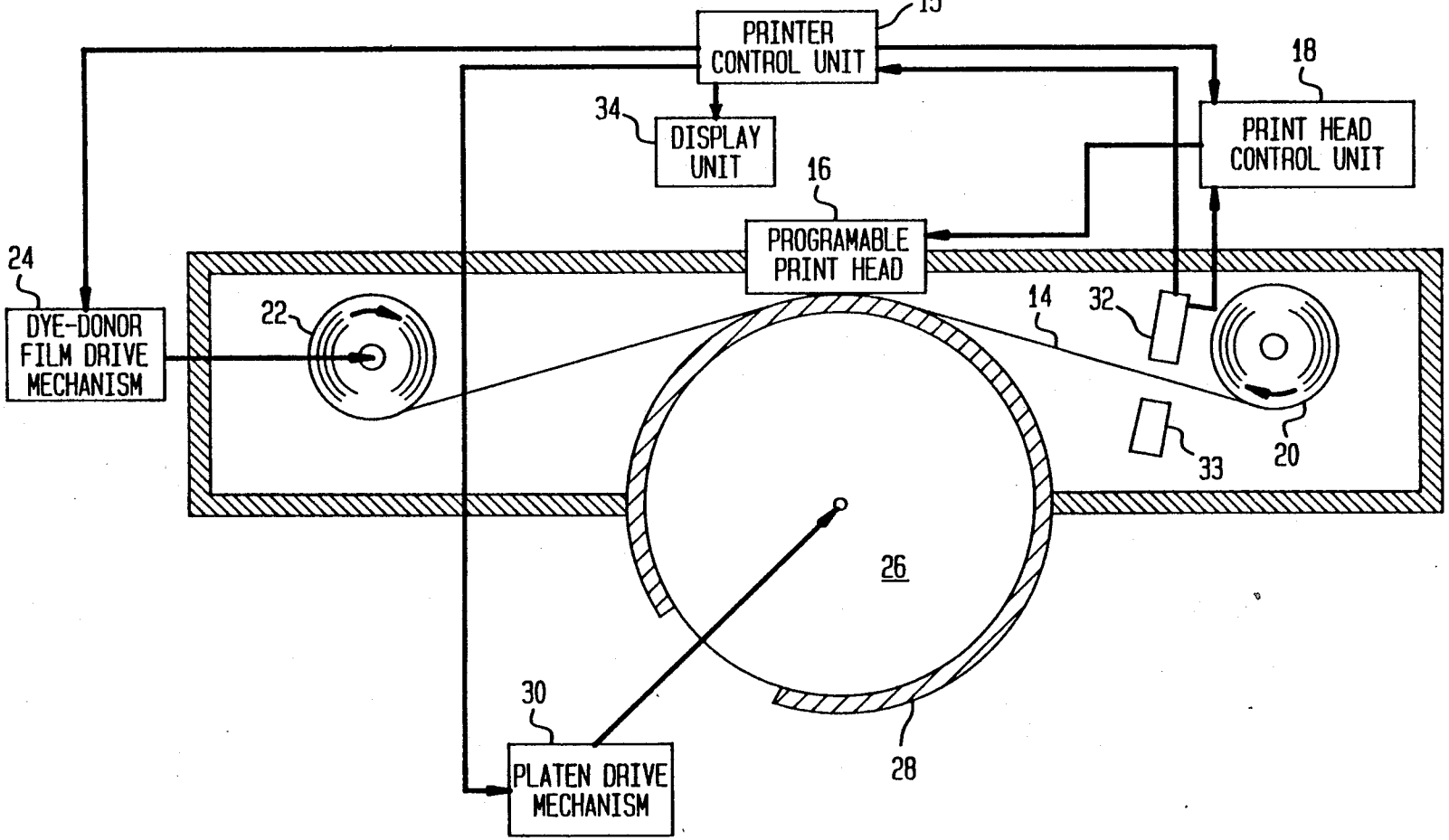
FIG. 1 shows in block and cross-sectional view a thermal printer in accordance with the present invention.
Figure 2:
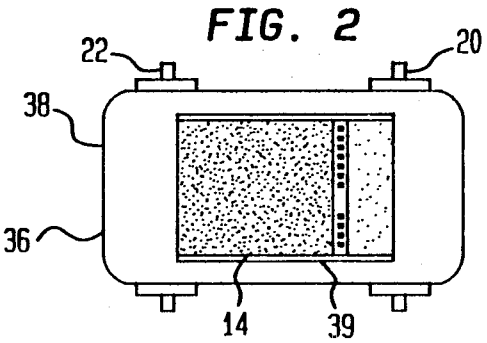
FIG. 2 shows a top view of a cartridge of dye-donor film.

Referring now to FIG. 1, there is shown schematically a thermal printer 10. In operation, the thermal printer 10 utilizes a dye-donor film 14 which is made in accordance with the present invention. The printer 10 comprises a printer control unit 15, a programmable print head 16, a print head control unit 18, a supply spool 20 for the dye-donor film 14, a take-up spool 22 for the dye-donor film 14, a dye-donor film drive mechanism 24, a rotatable platen 26 for transporting a receiver 28, a platen drive mechanism 30, a detector 32 and an associated light source 33, and a display unit 34. In a typical thermal printer, the dye-donor film 14, the supply spool 20 and the take-up spool 22 are contained in a cartridge 36. Cartridge 36 is shown in FIG. 2 but is not shown in FIG. 1.

The printer control unit 15 is coupled by first, second and third outputs to an input of the dye-donor film drive mechanism 24, to an input of the platen drive mechanism 30, to an input of the print head control unit 18 and to an input of the display unit 34, respectively. The print head control unit 18 is coupled by an output to an input of the print head 16. The detector 32 is coupled by first and second outputs to inputs of the print head control unit 18 and the printer control unit 15, respectively. The platen drive mechanism 30 and dye-donor film drive mechanism 24 are coupled to drive the platen 26 and the take-up spool 22, respectively, through conventional motor drive systems. The supply spool 20 rotates in response to the force of the film 14 being pulled by the take-up spool 22.

In operation, the thermal printer 10 performs under the control of the printer control unit 15. At the beginning of a print cycle, the printer control unit 15 signals to the platen drive mechanism 30 to rotate the platen 26 to bring a leading edge of the receiver 28 into alignment with the print head 16. At the same time, the printer control unit 15 directs the dye-donor film drive mechanism 24 to rotate the take-up spool 22 and advance the dye-donor film 14 to a starting position. This is accomplished by advancing the dye-donor film 14 until the detector 32 locates a coded marking (not shown in FIG. 1) on the dye-donor film 14. The detector 32 is a conventional array of optical sensors that generate signals associated with the presence and absence of sensed light from the light source 33. When the detector 32 locates the coded marking, certain operating information is transmitted from the detector 32 to the print head control unit 18 and the display unit 34 via the printer control unit 15. Details of this operating information are discussed later herein below.

The printer control unit 15 then begins to control and coordinate the print head control unit 18, the dye-donor film drive mechanism 24, and the platen drive mechanism 30 as an image is progressively formed on the receiver 28. The image is formed in accordance with conventional thermal printing techniques such as those described in U.S. Pat. Nos. 4,745,413 (Scott Brownstein et al.) and 4,710,783 (Holden Caine et al.) which are incorporated herein by reference.

Referring now to FIG. 2, there is shown a top view of a cartridge 36 for holding the dye-donor film 14. The cartridge 36 comprises an outer case 38 which supports the supply spool 20 and the take-up spool 22. An opening 39 extends through the case 38 from a top surface to a bottom surface thereof.

When the cartridge 36 is loaded into the printer 10, the opening 39 aligns with the print head 16. The opening 39 is large enough to accommodate the width of the print head 16. The opening 39 also aligns with the platen 26 and is large enough to accommodate the width of the platen 26. Thus the dye-donor film 14 within the opening 39 is free to contact the receiver 28 and the print head 16 during printing.

Figure 3:
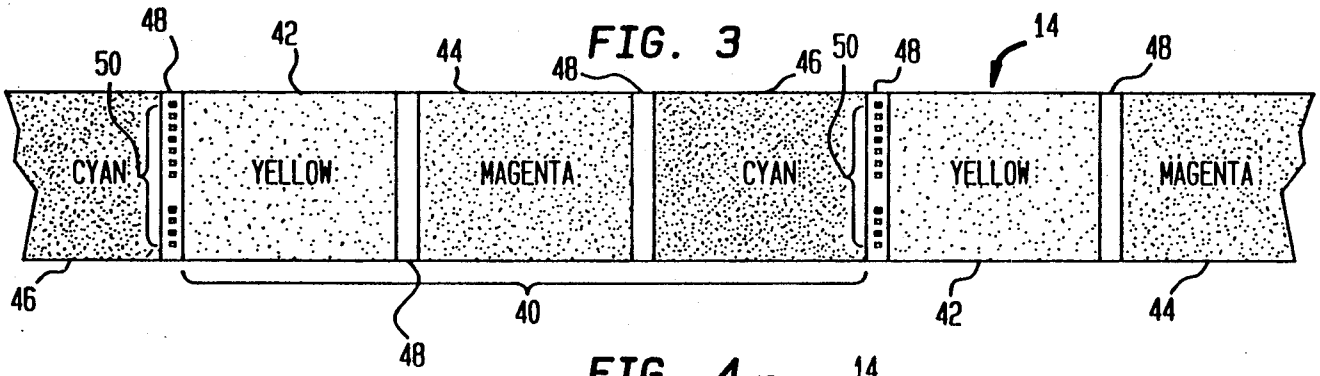
FIG. 3 shows an expanded top view of a portion of the dye-donor film used in the thermal printer of FIG. 1.

Referring now to FIG. 3, there is shown a portion of the dye-donor film 14 with repeating sets 40 of dye patches coated thereon. In a preferred embodiment of the present invention, each of the sets 40 comprises a yellow dye patch 42, a magenta dye patch 44, and a cyan dye patch 46. Between each of the dye patches a clear space 48 exists. A code marking 50 is printed in the clear space 48 between each of the cyan patches 46 and each of the yellow patches 42. One of the code markings 50 thus appears for each of the sets 40. In other embodiments of the invention, the sets 40 may comprise any number of colors or simply black patches. Sequencing of colors may also vary from the preferred embodiment. For example, yellow may precede cyan or the set 40 may begin with the color magenta.

Figure 4:
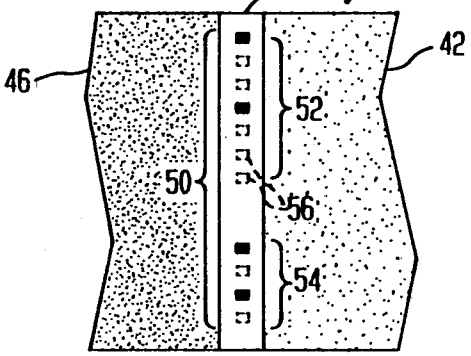
FIG. 4 shows an expanded top view of a portion of the dye-donor film of FIG. 3.

Referring now to FIG. 4, there is shown a detailed view of one of the code markings 50. In the preferred embodiment, the code marking 50 consists of two fields of information, a film length information field 52 and a color-balance information field 54. Within the scope of the present invention, the code marking 50 may comprise any number of fields of information. For illustrative purposes, only two fields are shown and discussed herein. Each of the fields 52 and 54 are comprised of information positions 56 which are shown in FIG. 4 as a series of dashed-line squares. The dashed-line squares are not, in fact, present on the dye-donor film 14 but the squares are shown in FIG. 4 for illustrative purposes.

The information fields 52 and 54 are encoded with information by placing an opaque ink into selected ones of the information positions 56. By way of example, the information positions 56 which are the first and fourth position in the field 52, counting from the top, are shown darkened (indicating the presence of opaque ink at these locations). This pattern of ink spots can be read in a binary system as the number seventeen. The film length information field 52 has seven information positions and consequently, the field 52 can be encoded with any number from zero to one hundred twenty eight using a binary system. Similarly, the color-balance information field 54 which consists of four information positions, can be encoded with one of a possible range of seventeen numbers (0 to 16). The number which is in the color-balance information field 54 is identifiable with a color-balance rating of the dye-donor film 14 in a particular one of the cartridges 36.

The code marking 50 can be used in many ways to improve the operations of the thermal printer 10. For illustrative purposes, two uses of the code marking color-balance coding and dye set sequence are explained below.

Referring back to FIGS. 1 and 2, it can be seen how one portion of the code markings 50 can be advantageously used in the operation of the printer 10. The detector 32 reads the binary number encoded into the film length information field 52 as each unused dye-patch set 40 is advanced to the print head 16. The binary information from the film length information field 52 is transmitted to the printer control unit 15. The printer control unit 15 converts the binary information into a corresponding Arabic numeral signal and transmits the Arabic numeral signal to the display unit 34 where it can be easily read by an operator of the printer 10. The printer 10 is thus capable of displaying an identifying number of the dye-patch set 40 which is adjacent the print head 16. This capability greatly improves a mode of operation of the printer 10 in which various ones of the cartridges 36 are unloaded from the printer 10 and reloaded at other times. Whenever one of the cartridges 36 is loaded into the printer 10, an operator is immediately made aware of the number of the dye-patch sets 40 remaining unused in the cartridge 36.

An additional operational improvement of the printer 10 is achieved through the use of the information in the color balance information field 54 of the film 14.

Figure 5:
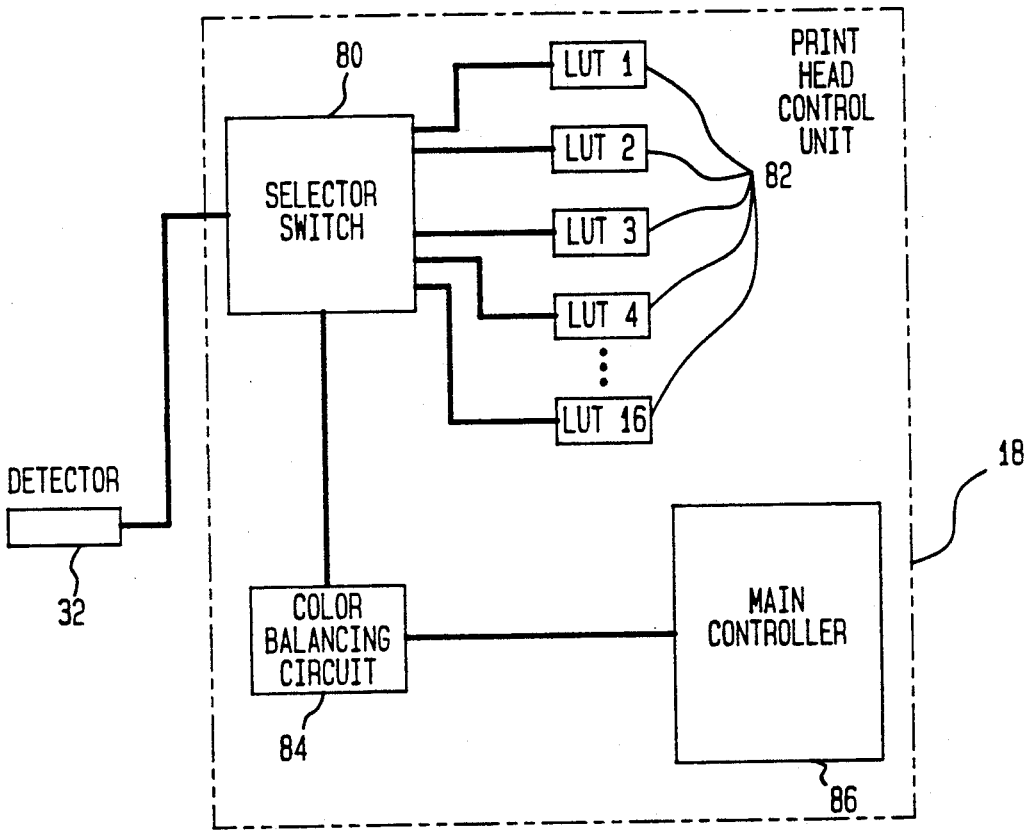
FIG. 5 shows, in block diagram form the detector and an embodiment of a print head control unit of the thermal printer of FIG. 1.

Referring now to FIG. 5, there is shown the detector 32 of FIG. 1 coupled to a preferred block diagram embodiment of the print head control unit 18 that illustrates a color balancing feature of the unit 18. The print head control unit 18 comprises a selector switch 80, sixteen look-up tables (LUT) 82, a color balancing circuit 84 and a conventional main controller 86. FIG. 5 also shows the detector 32 coupled to the selector switch 80. The selector switch 80 is coupled to the color balancing circuit 84 and is selectively coupled to any one of the LUTs 82. The color balancing circuit 84 is coupled to the main controller 86.

In operation, the detector 32, upon sensing information from the color balance information field 54 of the dye-donor film 14, transmits a detected binary number to the selector switch 80. The selector switch 80 acts in the response to the signal from the detector 32 to connect one of the LUTs 82 with the color balancing circuit 84. The particular choice of which one of the LUTs 82 is to be connected is a function of the coded color-balance signal transmitted to the selector switch 80.

The color balancing circuit 84 then performs a color balancing function for the printer 10 by transmitting color balancing information to the main controller 86. The operation of the color balancing circuit 84 can be understood by referring to U.S. Pat. No. 4,849,775 (M. Izumi) which is incorporated herein by reference.

Accordingly, whenever one of the cartridges 36 is loaded into the printer 10, the printer is immediately programmed to perform in an optimum manner with respect to the color balance of the particular dye-donor film in the loaded cartridge 36.

In order to understand the full scope of the present invention, some consideration must be given to the method of producing the code markings 50 on the dye-donor film 14. The dye-donor film 14 is a product of an extensive manufacturing operation. Some steps of the manufacturing operation are the subject matter of the present invention.

A conventional gravuring process (not shown) is used to coat a wide web of 0.00025 inch thick transparent polyethylene terephthalate with sequential horizontal stripes of yellow, cyan and magenta dyes with clear spaces interspersed between each stripe. The coated web is wound into a roll which is then removed from the gravuring operation. The gravuring operation is not capable of producing any of the code markings 50 on the film 14. Creation of the code markings 50 must be performed in a step separate from the gravuring operation.

Figure 6:
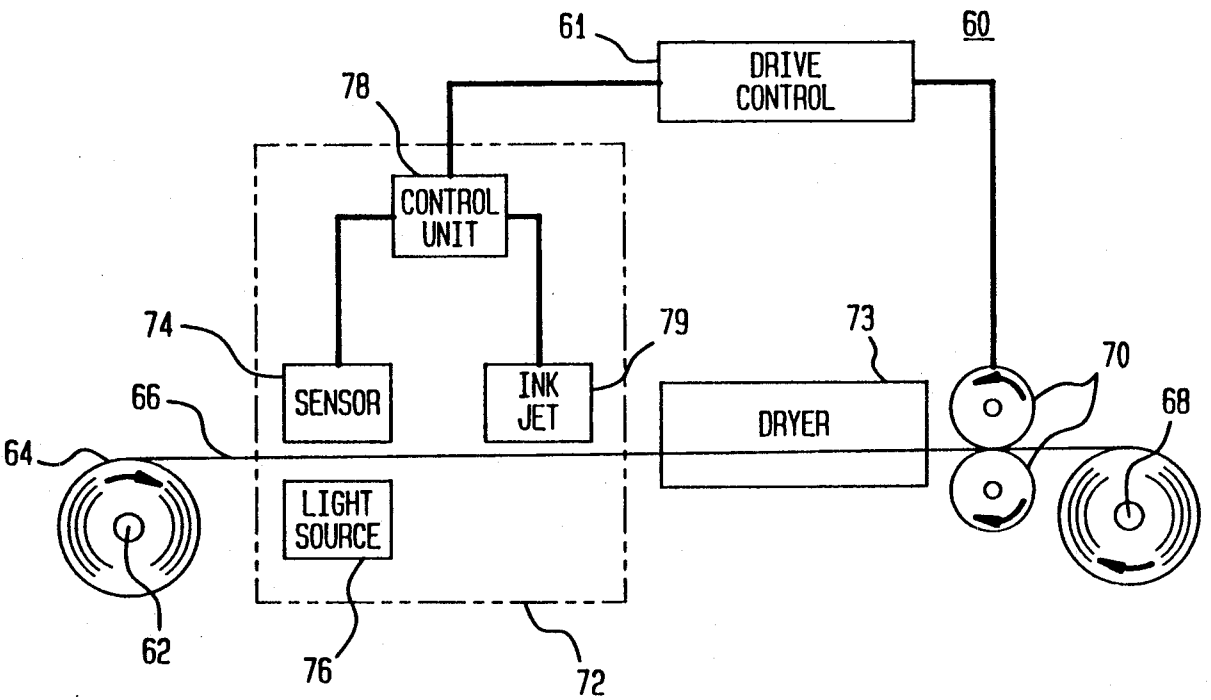
FIG. 6 shows in block diagram and cross-sectional view an apparatus for coding dye-donor film in accordance with the present invention.

Referring now to FIG. 6, there is shown schematically a coding machine 60 which performs a film coding operation in accordance with the present invention. The coding machine 60 comprises a supply arbor 62 for supporting a roll 64 of dye-coated web 66 in the form that is produced by the previously described conventional gravuring operation. The coding machine 60 also comprises a drive control 61, a take-up spool 68, a set of drive wheels 70, a code-marking unit 72 (shown with a dashed line rectangle) and a dryer 73. The code marking unit 72 comprises a sensor 74, a light source 76, a control unit 78 and an ink jet print head 79.

The drive control 61 is coupled to the drive wheels 70 through conventional motor speed controls to accurately control the linear speed of the web 66 as it passes through the machine 60. The drive control 61 is also coupled to the control unit 78 of the code-marking unit 72 to coordinate the functioning of the code-marking unit 72 with the linear speed of the web 66. Within the code-marking unit 72 the control unit 78 is coupled to the sensor 74 and the ink-jet print head 79.

In operation, the web 66 is unwound from the roll 64, advanced through the code-marking unit 72 and dryer 73, and rewound on the take-up arbor 68. The ink-jet print head prints a preselected color-balance code into a location on the web 66 that corresponds to the color balance information field 54. One of sixteen possible color-balance codes is assigned to each one of the rolls 64 on the basis sensitometry testing of the web 66 performed after completion of the gravuring operation. The ink-jet print head 79 prints the selected color-balance code onto a plurality of locations on the web 66 across its width because the web is much wider than the dye-donor film 14 which eventually is placed in the cartridges 38.

At the same time that the color-balance code is printed on the web 66, the control unit 68 signals the ink-jet print head 79 to print a dye-patch set sequence number in each location on the web 66 that corresponds to one of the film length information fields 52. The dye-patch set codes are repeating sets of sequential binary numbers ranging from one to one hundred.

The web 66 passes through a dryer 73 prior to being rewound on the take-up spool 68. This assures that the code markings 50 produced by the ink-jet printing head 79 are completely dry before rewinding the web 66.

In one embodiment of the present invention, the web 66 is subjected to a conventional slitting operation while being rewound from the roll 64 onto the take-up spool 68. This is an operation in which conventional slitter blades (not shown) are used to cut the web 66 into a plurality of narrower strips which are a proper width for placement into the cartridges 36.

In a further processing step (not shown), the narrow strips of the film 14 are cut into shorter pieces which are equivalent in length to one hundred of the dye-patch sets 40. These shorter 100 set lengths are then packaged into the cartridges 36 using conventional packaging techniques.

It is to be understood that the specific designs and methods described as exemplary embodiments are merely illustrative of the spirit and scope of the invention. Modifications can be made in the specific designs and methods consistent with the principles of the invention. For example, although the invention has been described in terms of improving color balance and dye-donor film cartridge interchangeability in a thermal printer, it has application to other forms of performance improvement in thermal printers. Still further, the coding operation has been described as being performed on a wound roll of dye coated web. It is possible to perform a coding operation on a dye coated web manufactured using a gravuring process prior to winding the dye coated web into a roll if the coding is performed after gravuring is completed.

The invention has been described in detail with particular reference to certain preferred embodiments thereof, but it will be understood that variations and modifications can be effected within the spirit and scope of the invention.

What is claimed is:

1. A method of making a dye-donor film for thermal printing comprising the steps of:

coating one side of a clear web with successive sets of colored patches of dyes in a gravuring process leaving clear spaces between the successive sets of patches; and subsequently printing a color balancing and film length code marking in the clear spaces between each set of dye patches after all the successive sets of dye patches are coated onto the web, said color balancing and film length code markings for each set of associated dye patches containing color balancing information and frame count information for said set of associated dye patches.

2. The method of producing dye-donor film of claim 1 comprising the further steps of:

performing sensitometry measurements on the coated film and obtaining results; and translating the results of said sensitometry measurement into one of a plurality of preselected codes that relate to said measurements so that the color balancing code marking applied in the printing step reflects the results of the sensitometry measurements.

3. A method of producing dye-donor films for thermal printing comprising the steps of:

unwinding a clear web from a first roll;

coating on side of the clear web with successive sets of colored patches of dyes in a gravuring process, leaving clear spaces between the successive sets of patches;

rewinding the coated web onto a second roll;

unwinding the coated web from the second roll; and printing a color balancing and film length code marking in the clear spaces between each of the successive sets of dye patches.

4. The method of producing dye-donor film of claim 3 comprising the further step of slitting the dye-donor film into narrower borderless widths while winding the film onto the third roll.

* * * * *